US009874151B2

(12) United States Patent
Melis et al.

(10) Patent No.: US 9,874,151 B2
(45) Date of Patent: Jan. 23, 2018

(54) METHOD AND SYSTEM FOR OPERATING A CAM-DRIVEN PUMP

(71) Applicant: GM GLOBAL TECHNOLOGY OPERATIONS LLC, Detroit, MI (US)

(72) Inventors: Massimiliano Melis, Rivoli (IT); Francesco Concetto Pesce, Turin (IT); Stefano Nieddu, Turin (IT); Andrea Mollar, La Loggia (IT)

(73) Assignee: GM GLOBAL TECHNOLOGY OPERATONS LLC, Detroit, MI (US)

( * ) Notice: Subject to any disclaimer, the term of this patent is extended or adjusted under 35 U.S.C. 154(b) by 104 days.

(21) Appl. No.: 15/154,251

(22) Filed: May 13, 2016

(65) Prior Publication Data

US 2016/0333799 A1 Nov. 17, 2016

(30) Foreign Application Priority Data

May 14, 2015 (GB) ..... 1508283.7

(51) Int. Cl.

| | |
|---|---|
| ***F02D 1/10*** | (2006.01) |
| ***F02D 41/30*** | (2006.01) |
| ***F04B 19/22*** | (2006.01) |
| ***F04B 17/05*** | (2006.01) |
| ***F04B 49/22*** | (2006.01) |
| ***F04B 49/06*** | (2006.01) |
| ***F02D 41/38*** | (2006.01) |
| ***F04B 9/04*** | (2006.01) |
| ***F04B 49/03*** | (2006.01) |

(Continued)

(52) U.S. Cl.

CPC ..... *F02D 1/10* (2013.01); *F02D 41/3005* (2013.01); *F02D 41/3845* (2013.01); *F04B 9/042* (2013.01); *F04B 17/05* (2013.01); *F04B 19/22* (2013.01); *F04B 49/03* (2013.01); *F04B 49/065* (2013.01); *F04B 49/22* (2013.01); *F04B 53/14* (2013.01); *F02D 41/042* (2013.01); *F02D 2041/224* (2013.01); *F02D 2200/101* (2013.01); *F02M 59/102* (2013.01)

(58) Field of Classification Search

CPC .... F02M 59/102; F02M 59/027; F02M 59/02; F02M 59/022; F02M 59/025; F04B 9/042; F04B 53/14; F04B 19/22; F04B 9/04; F04B 17/05; F04B 49/22; F04B 49/065; F04B 49/03; F02D 1/10; F02D 41/3005; F02D 41/3845

See application file for complete search history.

(56) References Cited

U.S. PATENT DOCUMENTS 6,651,545 B2 11/2003 Nippert
7,779,629 B2 8/2010 Isono et al.

FOREIGN PATENT DOCUMENTS

EP 2306012 A2 4/2011

OTHER PUBLICATIONS

Great Britain Patent Office, Great Britain Search Report for Great Britain Application No. 1508283.7, dated Nov. 17, 2015.

*Primary Examiner* — Sizo Vilakazi
(74) *Attorney, Agent, or Firm* — Lorenz & Kopf LLP

(57) ABSTRACT

A method for automatically operating a cam-driven pump is disclosed. The pump is monitored to determine whether a specified detachment condition or potential detachment of an actuator of the pump from a driving cam is occurring. The pump is operated in a minimal pressure holding mode to provide a minimal pressure within a working chamber of the pump so as to bias the actuator towards the cam if it is determined that the detachment condition is occurring.

17 Claims, 1 Drawing Sheet

(51) Int. Cl.

| | |
|---|---|
| ***F04B 53/14*** | (2006.01) |
| *F02M 59/10* | (2006.01) |
| *F02D 41/04* | (2006.01) |
| *F02D 41/22* | (2006.01) |

METHOD AND SYSTEM FOR OPERATING A CAM-DRIVEN PUMP

CROSS-REFERENCE TO RELATED APPLICATION

This application claims priority to Great Britain Patent Application No. 1508283.7, filed May 14, 2015, which is incorporated herein by reference in its entirety.

TECHNICAL FIELD

The present disclosure pertains to a method and an operating system for automatically operating a cam-driven pump, a pump arrangement including the operating system, an internal combustion engine arrangement including the pump arrangement, a vehicle including the internal combustion engine arrangement and a computer program product for carrying out the method.

BACKGROUND

In general, pumps are known to include plungers which are driven by rotating cams. Such pumps may be used to feed internal combustion engines, in particular so-called common rails. In particular when such internal combustion engines are cut-off for example in a sailing mode of a vehicle, the plunger may be temporarily detached or uncoupled from the driving cam due to its inertia. This disadvantageously may impair plunger and/or cam. Accordingly, there is a need for improved operation and performance, in particular sustainability, of cam-driven pumps.

SUMMARY

According to one aspect of the present disclosure, a pump arrangement includes a pump having a rotating cam and an actuator which is driven, by the rotating cam (i.e., a "cam-driven pump"). According to one embodiment the actuator may include, in particular be, a plunger and/or cam follower which in- and decreases a volume of a working or pumping chamber of the pump or is adapted thereto respectively.

According to one embodiment the pump may be a gas and/or liquid pump, such as a fuel pump feeding a common fuel rail of an internal combustion engine. According to one embodiment the internal combustion engine may be an internal combustion engine of a vehicle, in particular a passenger. According to one embodiment the cam may be connected to and driven by the internal combustion engine, in particular a camshaft thereof. According to one embodiment the pump may be a high-pressure and/or piston or plunger pump of a common-rail system.

According to one embodiment the pump arrangement includes a valve arrangement connected to or in fluid communication with the cam-driven pump respectively. The valve arrangement may include an inlet valve connected to or in fluid communication with an inlet port of the pump respectively. The inlet valve may be a so-called suction control or pump Digital Inlet Valve ("DIV").

Additionally or alternatively, the valve arrangement may include an outlet valve connected to or in fluid communication with an outlet port of the pump, respectively according to one embodiment. The outlet valve may be connected to or in fluid communication with the outlet port via a reservoir, such as a common rail of a common rail system or the internal combustion engine respectively for providing fuel to cylinders of the internal combustion engine. Accordingly, the outlet valve may be a so-called Pressure Regulator Valve ("PRV") of a common rail (system) of the internal combustion engine. Thus, the outlet valve may be connected to or in fluid communication with the outlet port indirectly according to one embodiment. The outlet valve may be controlled to limit a pressure within the common rail to a predetermined upper threshold in a normal operating mode different from a minimal pressure holding mode explained in further detail below according to one embodiment.

The inlet and/or outlet valve may be controlled automatically, in particular simultaneously and/or hydraulically, pneumatically and/or electrically, in particular electromagnetically and/or mechanically, by an operating system, in particular a control system, and/or according to a method described herein. By using both, an inlet and an outlet valve, a faster set-point adjustment of a pressure state within a common rail after ending a cut-off condition of an internal combustion engine may be achieved according to one embodiment.

According to one aspect of the present disclosure it is, in particular automatically, determined whether an actual or potential detachment or uncoupling condition of the actuator of the pump from the driving cam is fulfilled, and the pump is, in particular automatically, operated in or switched into a minimal pressure holding mode respectively to provide a minimal pressure state within a working chamber of the pump so as to bias the actuator towards the cam if or depending on whether it is determined that the detachment condition is fulfilled respectively. The minimal pressure state in particular being specified so as to provide at least a pre-specified biasing force towards the cam to the actuator.

The minimal pressure state within the working chamber may be provided by changing a hub and/or area of a working or actuator respectively like a blade and/or a plunger or piston of the pump respectively. According to one embodiment the pressure state within the working chamber is provided or controlled by controlling the valve arrangement. Thus, according to one embodiment operating the pump in a minimal pressure holding mode may include controlling the valve arrangement, in particular automatically, in a minimal pressure holding mode respectively to provide the minimal pressure state within the working chamber of the pump so as to bias the actuator towards the cam if or depending on whether it is determined that the detachment condition is fulfilled respectively. The minimal pressure state in particular being specified so as to provide, in particular at least, a (pre)specified biasing force towards the cam to the actuator.

An operating system, in particular a control system, according to one aspect of the present disclosure is adapted for carrying out a method described herein and/or includes a sensor or other means for, automatically determining whether a specified detachment condition of potential detachment of the actuator of the pump from the driving cam is fulfilled, and a switch, controller or other means for automatically operating the pump in or switching the pump into a minimal pressure holding mode respectively to provide a minimal pressure state within a working chamber of the pump so as to bias the actuator towards the cam if or depending on whether it is determined that the detachment condition is fulfilled respectively. The minimal pressure state being specified so as to provide at least, a pre-specified biasing force towards the cam to the actuator.

According to one embodiment the switch, controller or other means for operating the pump in a minimal pressure holding mode may include a controller for automatically controlling the valve arrangement in or switching the valve arrangement into a minimal pressure holding mode respectively to provide the minimal pressure state within the working chamber of the pump so as to bias the actuator towards the cam if or depending on whether it is determined that the detachment condition is fulfilled respectively. The minimal pressure state in particular being specified so as to provide, in particular at least, a pre-specified biasing force towards the cam to the actuator. In other words, control of the valve arrangement is switched to a specific minimal pressure holding mode upon determining a specified detachment condition according to one embodiment.

According to one embodiment the minimal pressure state within a working chamber biases the actuator towards the cam in a potential detachment condition and therefore can advantageously reduce, in particular avoid, temporary detachment of the actuator from the cam.

According to one embodiment fulfillment of the detachment condition is determined based on a workload of a machine, in particular the internal combustion engine, feed by the pump and/or based on a speed of the cam. Accordingly a means for determining whether a specified detachment condition of potential detachment of the actuator of the pump from the driving cam may include a sensor or other means for determining fulfillment of the detachment condition based on a workload of a machine, in particular the internal combustion engine, feed by the pump and/or based on a speed of the cam. The workload of a machine feed by the pump and the speed of the cam may influence the risk of temporary detachment of the actuator from the cam. Thus, determining fulfillment of the detachment condition based on machine workload and/or cam speed can advantageously reduce, in particular avoid, temporary detachment of the actuator from the cam according to one embodiment.

The risk of temporary detachment may arise or increase if the machine is cut-off and/or cam speed becomes too high. Thus according to one embodiment fulfillment of the detachment condition is determined if the machine is cut-off and/or the speed of the cam exceeds a predetermined threshold. Accordingly the means for determining whether a specified detachment condition of potential detachment of the actuator of the pump from the driving cam is fulfilled may include a sensor or other means for determining fulfillment of the detachment condition if the machine is cut-off and/or the speed of the cam exceeds a predetermined threshold. Thus, the detachment condition may in particular be a one- or, in particular cumulative, two-stage condition.

According to one embodiment the inlet valve is controlled to provide a specified intake quantity if fulfillment of the detachment condition is determined. Additionally or alternatively the outlet valve is controlled to provide the minimal pressure, in particular within the reservoir, in particular the common rail, if fulfillment of the detachment condition is determined. Accordingly the means for controlling the valve arrangement may include, in particular be, a controller or other means for controlling the inlet valve to provide a specified intake quantity if fulfillment of the detachment condition is determined. Additionally or alternatively the means for controlling the valve arrangement may include a controller or other means for controlling the outlet valve to provide the minimal pressure within the reservoir, in particular the common rail, if fulfillment of the detachment condition is determined.

Controlling the outlet valve to provide the minimal pressure may include controlling the outlet valve to provide an outlet pressure corresponding to the minimal pressure, in particular opening upon or not before reaching the minimal pressure respectively, according to one embodiment.

According to one embodiment by providing a specified intake quantity, in particular volume and/or mass, the minimal pressure state within the working chamber can be controlled advantageously. Additionally or alternatively the minimal pressure state within the working chamber can be controlled advantageously by the outlet valve according to one embodiment.

According to one embodiment the minimal pressure state within the working chamber and/or reservoir may be specified or provided respectively based on a speed of the cam, in particular increase with increasing cam speeds no that a first minimal pressure state within the working chamber and/or reservoir is specified or provided respectively for a first speed of the cam and a larger second minimal pressure state within the working chamber and/or reservoir is specified or provided respectively for a larger second speed of the cam. Since higher cam speeds may increase the inertia forces and therefore the detachment risk, increasing the minimal pressure state within the working chamber with increasing cam speeds may advantageously reduce, in particular avoid, temporary detachment of the actuator from the cam according to one embodiment.

Additionally or alternatively, according to one embodiment the intake quantity may be specified based on a speed of the cam, in particular increase with increasing cam speeds so that a first intake quantity is specified for a first speed of the cam and a larger second intake quantity is specified for a larger second speed of the cam. Since higher cam speeds may increase the inertia forces and therefore the detachment risk, specifying the intake quantity to increase with increasing cam speeds may advantageously reduce, in particular avoid, temporary detachment of the actuator from the cam according to one embodiment.

Thus according to one embodiment the means for controlling the valve arrangement may include a controller or other means for controlling the valve arrangement to provide a minimal pressure within the working chamber based on a speed of the cam, in particular a first minimal pressure within the working chamber for a first speed of the cam and a larger second minimal pressure for a larger second speed of the cam.

According to one embodiment, when the detachment risk is reduced or diminishes, it may be advantageous to provide a specified pressure state within the reservoir, in particular based on a machine demand. In particular if a cut-off condition of the internal combustion engine ends, it may be advantageous to provide a specified pressure state within the common rail based on an internal combustion machine demand. The specified pressure state may be provided by the outlet valve in order to reach a desired or target pressure state within the common rail fast according to one embodiment, either alone or in combination with the inlet valve.

Thus according to one embodiment the outlet valve is controlled to provide a specified pressure state within the reservoir if it is determined that a non-detachment condition of unlikely detachment of the actuator from the cam is fulfilled. The specified pressure state may be determined based on a machine demand, in particular an internal combustion machine demand, and/or be different from the minimal pressure state which is provided during fulfillment of the detachment condition. Accordingly the means for controlling the valve arrangement may include a controller or other means for controlling the outlet valve to provide the specified pressure state within the reservoir if it is determined that the non-detachment condition of unlikely detachment of the actuator from the cam is fulfilled. The specified pressure state may be based on a machine demand, in particular an internal combustion machine demand, and/or be different from the minimal pressure state which is provided during fulfillment of the detachment condition.

The non-detachment condition may be complementary to the detachment condition or one or more stages thereof. Thus, the non-detachment condition may be already fulfilled if it is determined that the (internal combustion) machine is in a running or non-cut off condition respectively according to one embodiment.

The minimal pressure state provided within the working chamber (for) biasing the actuator towards the cam if it is determined that the detachment condition is fulfilled may be independent from a pressure demand of the internal combustion engine, in particular a fuel and/or common rail pressure demand.

According to one embodiment the minimal pressure state may provide or be specified so as to provide respectively a biasing force acting on the actuator towards the cam which is at least 2%, in particular at least 5%, in particular at least 10%, of a, in particular minimal, biasing force of a biasing means biasing the actuator towards the cam, in particular mechanically, hydraulically, pneumatically and/or electrically, in particular electromechancially and/or magnetically.

The biasing means may in particular permanently bias the actuator towards the cam or be adapted thereto respectively. It may in in particular include, in particular be, a mechanical, hydraulically and/or pneumatically spring biasing the actuator towards the cam.

By providing such minimal pressure state within the working chamber during detachment condition, such biasing means may be supported advantageously according to one embodiment so as to advantageously reduce, in particular avoid, temporary detachment of the actuator from the cam.

Additionally or alternatively the minimal pressure state may provide or be specified so as to provide respectively a biasing force acting on the actuator towards the cam which, in particular in combination with a supporting biasing force of the biasing means, avoids temporary or dynamical detachment of the actuator from the cam or maintains the actuator in permanent contact with the cam respectively, in particular when the machine, in particular internal combustion engine, is cut-off according to one embodiment. The biasing force provided by the minimal pressure state may in particular be at least 500 N, in particular at least 1000 N and in particular at least 1500 N, in particular depending on a speed of the cam as explained above.

Means according to one aspect of the present disclosure may be implemented by software, in particular a computer program or computer program module, and/or hardware, in particular a computer or central processing unit which is disposed to carry out a method described herein, one or more sensors and/or actors communicating with, in particular controlled by, the computer or central processing unit, or a computer program product, in particular a data carrier and a data storage device respectively, including program code which implements a method described herein when running on a computer or central processing unit. The computer program or computer program module may be stored on the data carrier and the data storage device respectively in particular in a non-volatile way.

The means may be implemented in an apparatus, and in particular in a controller. The system may also be understood as including means in terms of function module architecture that is to be realized or implemented by the computer program or computer program module.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
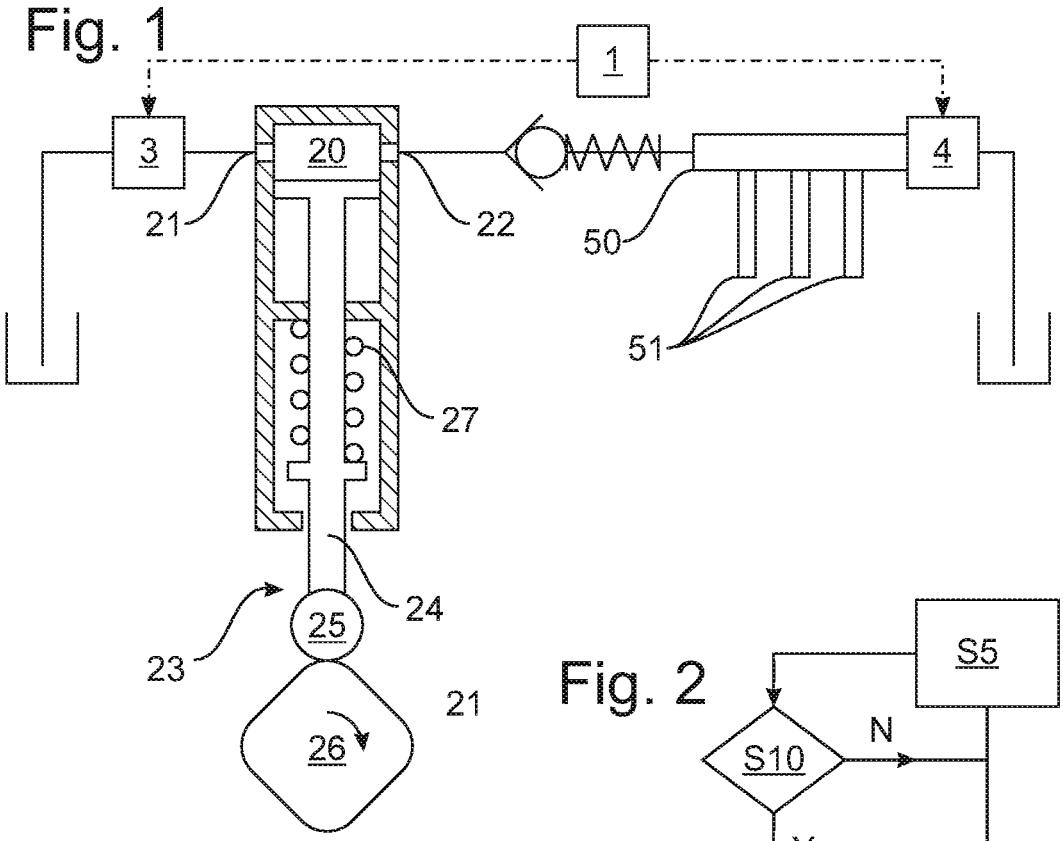
FIG. 1 depicts apart of an internal combustion engine arrangement with a pump arrangement including a control system according to an embodiment of the present disclosure.

FIG. 1 shows a part of an internal combustion engine arrangement with an internal combustion engine including injectors 51 and a pump arrangement including a control system in form of an ECU 1 according to an embodiment of the present disclosure.

The pump arrangement includes a cam-driven high-pressure fuel pump of a common rail system, including a working chamber 20 with an inlet port 21 and an outlet port 22, and an actuator 23 having a plunger 24 and a cam-follower 25 driven by a cam 26 which itself is driven by a camshaft of the internal combustion engine (not shown). Actuator 23 is permanently biased towards cam 26 by a biasing means in form of a spring 27.

The pump arrangement further includes a valve arrangement including an inlet valve in form of a DIV 3 in fluid communication with inlet port 21 and an outlet valve in form of a PRV 4 of the common rail system in fluid communication with outlet port 22 via a common rail 50 which both are automatically controlled by ECU 1.

The common rail system of the internal combustion engine includes the common rail 50 for feeding the injectors 51 of the internal combustion engine and the PRV 4.

ECU 1 automatically controls valve arrangement 3, 4 according to a method according to an embodiment of the present disclosure, the method being implemented by a computer program or a computer program module and described in further detail with reference to FIG. 2.

During normal non-cut off condition of the internal combustion engine ECU 1 controls or provides a pressure within common rail 50 respectively by controlling DIV 3 and/or PRV 4 in a step S5.

ECU 1 regularly proceeds to a step S10. In step S10 ECU 1 determines if the internal combustion engine is cut-off or not.

If ECU 1 determines that the internal combustion engine is not cut-off (S10: "N"), it returns to step S5.

If ECU 1 determines that the internal combustion engine is cut-off (S10: "Y"), it proceeds with step 320 in which it determines if a rotating speed of cam 26 exceeds a predetermined threshold or not. If it determines that the cam speed does not exceed the predetermined threshold (S20: "N"), ECU 1 also returns to step S5

If ECU 1 determines that the cam speed exceeds the predetermined threshold (S20: "Y"), ECU 1 determines that a specified detachment condition of potential detachment of actuator 23 from driving cam 26 is fulfilled and proceeds with step S30.

In step S30 ECU 1 specifies an intake quantity for DIV 3 and an outlet pressure for PRV 4 based on the cam speed. The outlet pressure for PRV 4 corresponds to a (pre) specified minimal pressure state within working chamber 20.

In an exemplary embodiment the intake quantity may be specified as being 50 $mm^3$ and/or the outlet or minimal pressure may be specified as being 500 bar if the cam speed is within a range between the predetermined threshold and the predetermined threshold plus 499 rounds per minute [rpm].

In the exemplary embodiment the intake quantity may be specified as being increased by 5 $mm^3$ and/or the outlet pressure may be specified as being increased by 50 bar for every further 500 rpm of cam speed beyond the predetermined threshold. In other words the intake quantity may be specified as being 55 $mm^3$ and/or the outlet pressure may be specified as being 550 bar if the cam speed is within a range between the predetermined threshold plus 500 rpm and the predetermined threshold plus 999 rpm, the intake quantity may be specified as being 60 $mm^3$ and/or the outlet pressure may be specified as being 600 bar if the cam speed is within a range between the predetermined threshold plus 1000 rpm and the predetermined threshold plus 1499 rpm and so forth.

ECU 1 then controls DIV 3 to provide the specified intake quantity and PRV 4 to provide the specified outlet or minimal pressure in step S30, thereby controlling the valve arrangement 3, 4 to provide a minimal pressure within working chamber 20 for biasing actuator 23 towards cam 26.

ECU 1 then proceeds to steps S40, S50 which correspond to steps S10, S20 respectively. As long as ECU 1 determines that the internal combustion engine is still cut-off (S40: "Y") and the cam speed still exceeds the predetermined threshold (S50: "Y"), ECU 1 returns to step S30 wherein it again specifies the intake quantity and outlet pressure based on an actualized cam speed.

If ECU 1 determines that either the internal combustion engine is no longer cut-off (S40: "N") or the cam speed does not exceed the predetermined threshold any more (S50: "N"), ECU 1 proceeds with step S60.

In the step S60 ECU 1 controls outlet valve 4 so as to quickly provide a specified pressure state within common rail 50 based on a pressure demand of the internal combustion engine since a non-detachment condition is fulfilled (S40 OR S50: "N"). ECU 1 then returns to step S5, i.e. into normal non-cut off operation.

Figure 2:
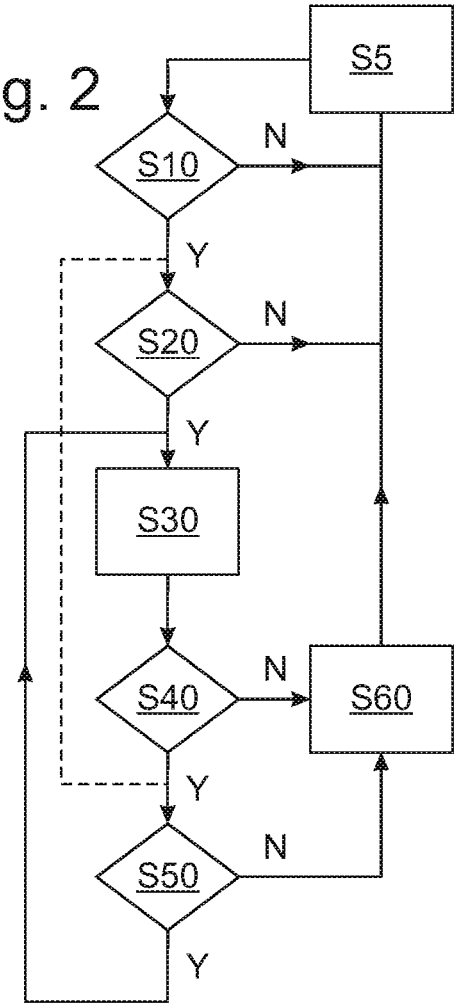
FIG. 2 is a flowchart illustrating a method according to an embodiment of the present disclosure, the method being implemented by a computer program or a computer program module and carried out by the control system.

According to another embodiment depicted by a broken line in FIG. 2, the non-detachment condition may only be fulfilled if the internal combustion engine is no longer cut-off (S40: "N"). In other words, if ECU 1 determines that the internal combustion engine is still cut-off (S40: "Y") it returns to step S30. In this other embodiment ECU 1 therefore returns to step S5 directly, i.e. without carrying out step S60, if it determines during cut-off condition (S40: "Y") that the cam speed does not exceed the predetermined threshold any more (S20: "N").

The ECU 1 may include a digital central processing unit (CPU) or processor in communication with a memory system and an interface bus. Instead of an ECU, the system may have a different type of processor to provide the electronic logic, e.g. an embedded controller, an onboard computer, or any processing module that might be deployed in the vehicle. The CPU is configured to execute instructions stored as a program in the memory system, and send and receive signals to and from the interface bus. The memory system may include various storage types including optical storage, magnetic storage, solid state storage, and other non-volatile memory. The interface bus may be configured to send, receive, and modulate analog and/or digital signals to and from the various sensors and control devices. The program may embody the methods disclosed herein, allowing the CPU to execute the steps of such control methods.

The program stored in the memory system is transmitted from outside via a cable or in a wireless fashion. Outside the system it is normally visible as a computer program product, which is also called transient or non-transient computer readable medium or machine readable medium in the art, and which should be understood to be a computer program code residing on a carrier, the carrier preferably being either transitory or non-transitory in nature with the consequence that the computer program product can be regarded to be transitory or non-transitory in nature.

An example of a transitory computer program product is a signal, e.g. an electromagnetic signal such as an optical signal, which is a transitory carrier for the computer program code. Carrying such computer program code can be achieved by modulating the signal by a conventional modulation technique such as QPSK for digital data, such that binary data representing the computer program code is impressed on the transitory electromagnetic signal. Such signals are e.g. made use of when transmitting computer program code in a wireless fashion via a WiFi connection to a laptop.

In case of a non-transitory computer program product the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method for automatically operating a cam-driven pump comprising:

determining whether a detachment condition indicating detachment of an actuator of the pump from a driving cam is fulfilled; and operating the pump in a minimal pressure holding mode to provide a minimal pressure within a working chamber of the pump so as to bias the actuator towards the cam when it is determined that the specific detachment condition is fulfilled.

2. The method according to claim 1, wherein operating the pump in a minimal pressure holding mode comprises controlling a valve arrangement in fluid communication with the pump in the minimal pressure holding mode to provide the minimal pressure within the working chamber of the pump so as to bias the actuator towards the cam when it is determined that the detachment condition is fulfilled.

3. The method according to claim 2, wherein the minimal pressure is specified to provide a biasing force acting on the actuator towards the driving cam that is at least the lesser of 2% of a biasing force of a spring biasing the actuator towards the driving cam and 500 N.

4. The method according to claim 2, further comprising:

controlling an inlet valve in fluid communication with an inlet port of the pump to provide a specified intake quantity; and controlling an outlet valve in fluid communication with an outlet port of the pump to provide the minimal pressure when fulfillment of the detachment condition is determined.

5. The method according to claim 4, wherein at least one of the minimal pressure within the working chamber and the intake quantity is specified based on a speed of the driving cam.

6. The method according to claim 5, wherein at least one of a first minimal pressure within the working chamber and a first intake quantity is specified for a first speed of the driving cam and at least one of a larger second minimal pressure within the working chamber and a larger second intake quantity is specified for a larger second speed of the cam.

7. The method according to claim 4, wherein the outlet valve communicates with the outlet port via a reservoir, the method further comprising controlling the outlet valve to provide the minimal pressure within the reservoir when fulfillment of the detachment condition is determined.

8. The method according to claim 7, further comprising controlling the outlet valve to provide a specified pressure state within the reservoir when the detachment condition indicates a non-detachment condition of unlikely detachment of said actuator from said cam is fulfilled.

9. The method according to claim 1, further comprising determining the detachment condition based on a workload of a machine feed by the pump.

10. The method according to claim 9, further comprising determining the detachment condition when the machine is cut-off.

11. The method according to claim 1, further comprising determining the detachment condition based on a speed of the driving cam.

12. The method according to claim 11, further comprising determining the detachment condition when a speed of the cam exceeds a predetermined threshold.

13. A non-transitory computer readable medium comprising source code executable on a processor for carrying out the method according to claim 1.

14. A control system for automatically operating a cam-driven pump, comprising a controller configured to:

determine whether a detachment condition indicating detachment of an actuator of the pump from a driving cam is fulfilled; and operate the pump in a minimal pressure holding mode to provide a minimal pressure within a working chamber of the pump so as to bias the actuator towards the cam when a specific detachment condition is fulfilled.

15. A pump arrangement comprising:

a cam-driven pump having a working chamber, an inlet port and an outlet port in fluid communication with the working chamber, a driving cam and an actuator operably coupled to the driving cam for displacement in the working chamber;

a valve arrangement having an inlet valve in fluid communication with the inlet port and an outlet valve in fluid communication with the outlet port; and a controller configured to:

determine whether a detachment condition indicating detachment of the actuator from the driving cam; and operate the pump in a minimal pressure holding mode to provide a minimal pressure within the working chamber for biasing the actuator towards the driving cam when a specific detachment condition is fulfilled.

16. An internal combustion engine comprising an internal combustion engine and a pump arrangement according to claim 15, wherein the cam-driven pump is configured to feed the a common fuel rail of the internal combustion engine.

17. A vehicle comprising an internal combustion engine comprising an internal combustion engine according to claim 16.

* * * * *